US010053800B2

(12) United States Patent
Massotte

(10) Patent No.: US 10,053,800 B2
(45) Date of Patent: Aug. 21, 2018

(54) DEVICE FOR GENERATING A FALSE TWIST AT A STRAND

(71) Applicant: SUPERBA S.A.S., Mulhouse (FR)

(72) Inventor: Philippe Massotte, Gueberschwihr (FR)

(73) Assignee: Superba S.A.S., Mulhouse (FR)

( * ) Notice: Subject to any disclaimer, the term of this patent is extended or adjusted under 35 U.S.C. 154(b) by 75 days.

(21) Appl. No.: 14/643,370

(22) Filed: Mar. 10, 2015

(65) Prior Publication Data

US 2015/0252498 A1 Sep. 10, 2015

(30) Foreign Application Priority Data

Mar. 10, 2014 (EP) ..... 14305342

(51) Int. Cl.

| | |
|---|---|
| ***D02G 1/02*** | (2006.01) |
| ***D02J 1/02*** | (2006.01) |
| ***B65H 51/015*** | (2006.01) |
| ***D01H 7/92*** | (2006.01) |
| ***D02G 1/12*** | (2006.01) |
| ***D06B 17/00*** | (2006.01) |

(52) U.S. Cl.

CPC ..... *D02G 1/024* (2013.01); *B65H 51/015* (2013.01); *D01H 7/92* (2013.01); *D02G 1/12* (2013.01); *D02J 1/02* (2013.01); *D06B 17/005* (2013.01); *B65H 2701/31* (2013.01)

(58) Field of Classification Search

CPC ..... D02G 1/04; D02G 1/082; D02G 1/085; D02G 1/024; D01H 7/92; D01H 7/923; D01H 7/926

See application file for complete search history.

(56) References Cited

U.S. PATENT DOCUMENTS

| | | | | |
|---|---|---|---|---|
| 3,136,110 | A * | 6/1964 | Searles | D02G 1/06 57/343 |
| 3,650,103 | A * | 3/1972 | Farrar | B65H 54/543 242/147 R |
| 4,372,107 | A * | 2/1983 | Hart | D01H 7/923 57/246 |
| 5,699,660 | A * | 12/1997 | Buluschek | H01B 13/0257 57/293 |
| 5,775,079 | A | 7/1998 | Hoover | |
| 5,799,477 | A * | 9/1998 | Seibert | H01B 13/0257 57/293 |
| 6,199,361 | B1 * | 3/2001 | Yakushi | D02G 1/0273 57/105 |

(Continued)

FOREIGN PATENT DOCUMENTS

| | | | |
|---|---|---|---|
| DE | 1635125 | A1 | 1/1971 |
| FR | 2581631 | A1 | 11/1986 |
| WO | 2012096799 | A1 | 7/2012 |

OTHER PUBLICATIONS

Europe Patent Application No. 14305342.9, Search Report dated Jul. 10, 2014.

*Primary Examiner* — Shaun R Hurley

(74) *Attorney, Agent, or Firm* — Kilpatrick Townsend & Stockton LLP; Dean W. Russell; Anthony L. Guebert

(57) ABSTRACT

Systems for controlling the movement of threads in systems for treating threads for carpets. Disclosed is a device for guiding a strand of at least two threads on a transporter structure, characterized in that the device employs a mechanism for generating false twists between the at least two threads of the strand.

13 Claims, 3 Drawing Sheets

(56) References Cited

U.S. PATENT DOCUMENTS

| | | | | |
|---|---|---|---|---|
| 6,302,308 | B1 | 10/2001 | Hoover et al. | |
| 6,378,283 | B1 * | 4/2002 | Barton | H01B 11/04 57/314 |
| 6,634,164 | B2 * | 10/2003 | Moser | H01B 13/0257 57/204 |
| 8,161,721 | B2 * | 4/2012 | Chiasson | D07B 3/005 57/293 |
| 8,161,722 | B2 * | 4/2012 | Chiasson | D07B 3/005 57/293 |
| 2006/0096270 | A1 | 5/2006 | Keith | |
| 2008/0301922 | A1 | 12/2008 | Hoover | |

* cited by examiner

DEVICE FOR GENERATING A FALSE TWIST AT A STRAND

CROSS REFERENCE TO RELATED APPLICATION

The present invention claims the benefit of European Patent Application No. 14305342.9 filed Mar. 10, 2014, the content of which is incorporated herein by reference in its entirety.

TECHNICAL FIELD

The present invention relates to the field of systems for treating threads for carpets and more particularly to the field of devices for controlling the movement of threads in these treatment systems.

BACKGROUND

At present, during simultaneous treatment of a plurality of threads, all of the treated threads, coming from a plurality of spools, are combined to produce a strand. This strand is then deposited in the form of flat loops onto a moving structure such as a conveyor belt. One example of a device for effecting this deposition in the form of flat loops of a strand of threads is described in the publication FR 2 581 631. Such a device enables homogeneous, uniform, tension-free and continuous deposition of the strand of threads onto the conveyor belt in the treatment system. At the exit from the treatment system, this homogeneous deposition allows facilitated take-up such that the different threads of the strand are then easily separated to enable feeding of the respective spools.

However, following the different treatment operations effected on this strand of a plurality of threads treated simultaneously, it has been observed that for the same treated strand some spools for feeding the strand with threads emptied faster than others. This difference in terms of emptying has been noted although the thread lengths of the different spools are all identical.

Accordingly, for spools of threads 20,000 meters long inserted simultaneously into the treatment system, the differences between the take-up spools at the exit are of the order of 200 meters or almost a 1% difference.

Such differences, on the one hand, in the paying out from feed spools and, on the other hand, in feeding the take-up spools, then lead not only to a problem in controlling the operations of replacing the spools on the upstream and downstream sides of the treatment system but also and most importantly to a lack of homogeneity between the different spools of treated thread obtained at the exit from the system.

An aim of the present invention is to alleviate these drawbacks by proposing a device that makes it possible to reduce or even to eliminate these variations in the stream of treated threads to obtain homogeneity, on the one hand, in paying out and, on the other hand, in the taking up of the thread by the spools, whilst being usable in existing thread treatment systems.

SUMMARY

The invention therefore consists in a device for guiding a strand of at least two threads on a transporter structure, characterized in that the device employs a mechanism for generating false twists between the at least two threads of the strand.

The invention also relates to a system for treating threads for carpets, characterized in that the system includes a device according to the invention for guiding a strand of at least one thread on a transporter structure, this device for guiding a strand being positioned between a mechanism for feeding threads to the strand and a mechanism for depositing the strand on a transporter structure.

The invention further consists in a method of guiding a strand of at least two threads on a transporter structure, characterized in that it includes at least one step of generating at least one false twist of the strand before the step of placing the strand on the transporter structure.

BRIEF DESCRIPTION OF THE DRAWINGS

The invention will be better understood thanks to the following description, which relates to a preferred embodiment, given by way of nonlimiting example and with reference to the appended diagrammatic drawings, in which.

DETAILED DESCRIPTION

Figure 1:
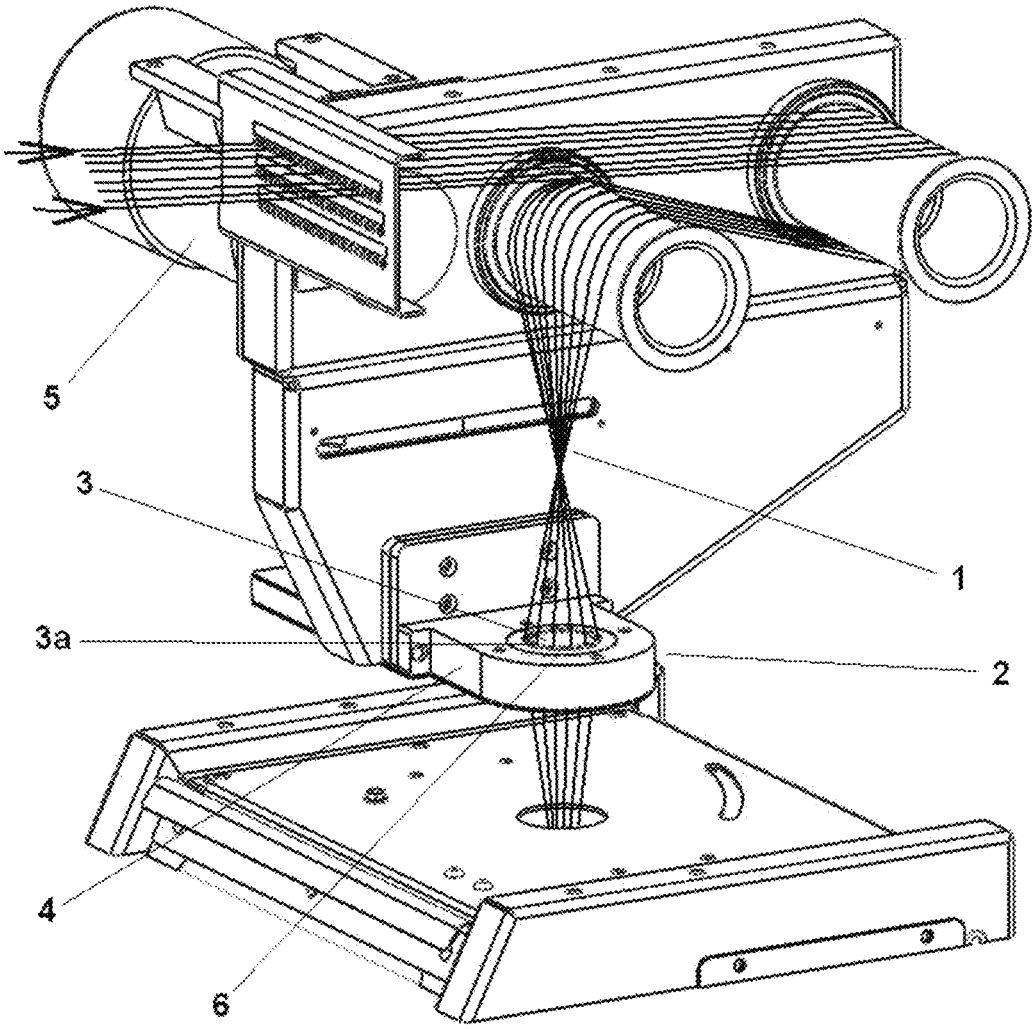
FIG. 1 is a diagrammatic representation of threads on a first embodiment of a device according to the invention.
Figure 2:
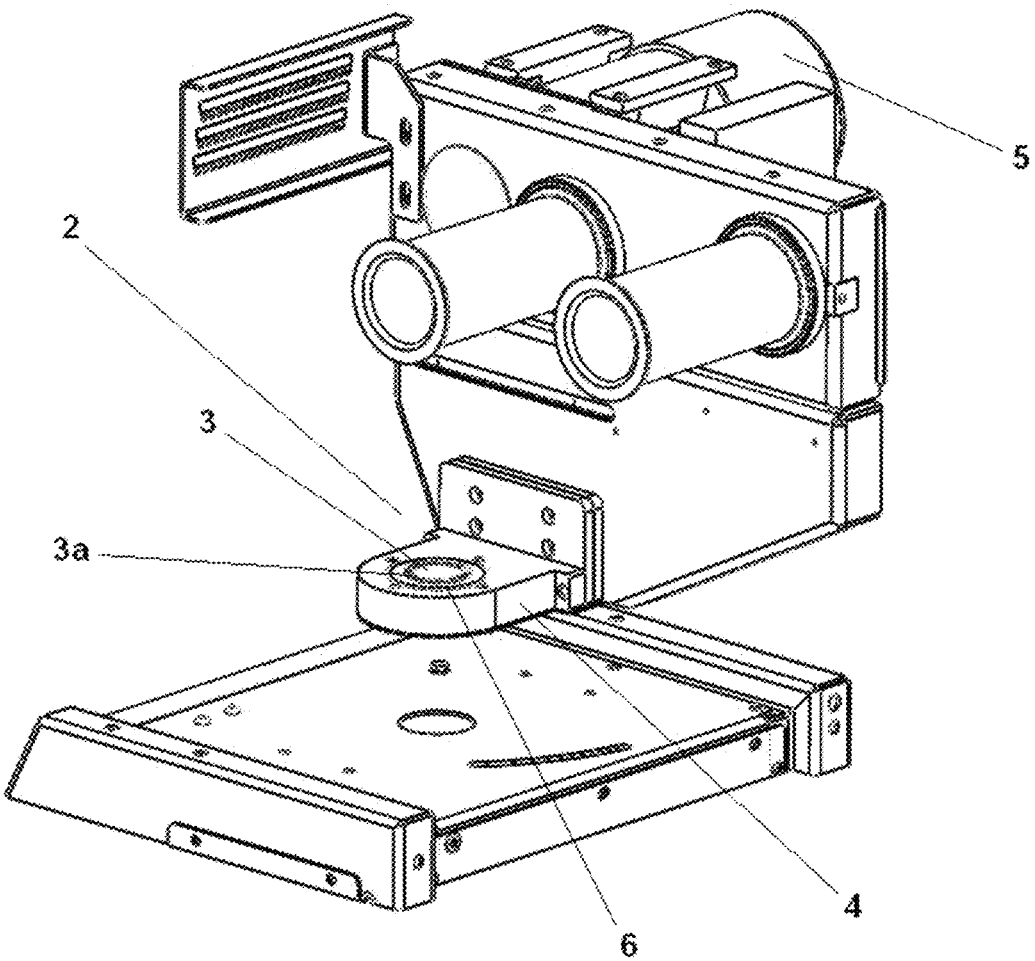
FIG. 2 is a diagrammatic representation of the first embodiment of the device according to the invention with no threads.
Figure 3:
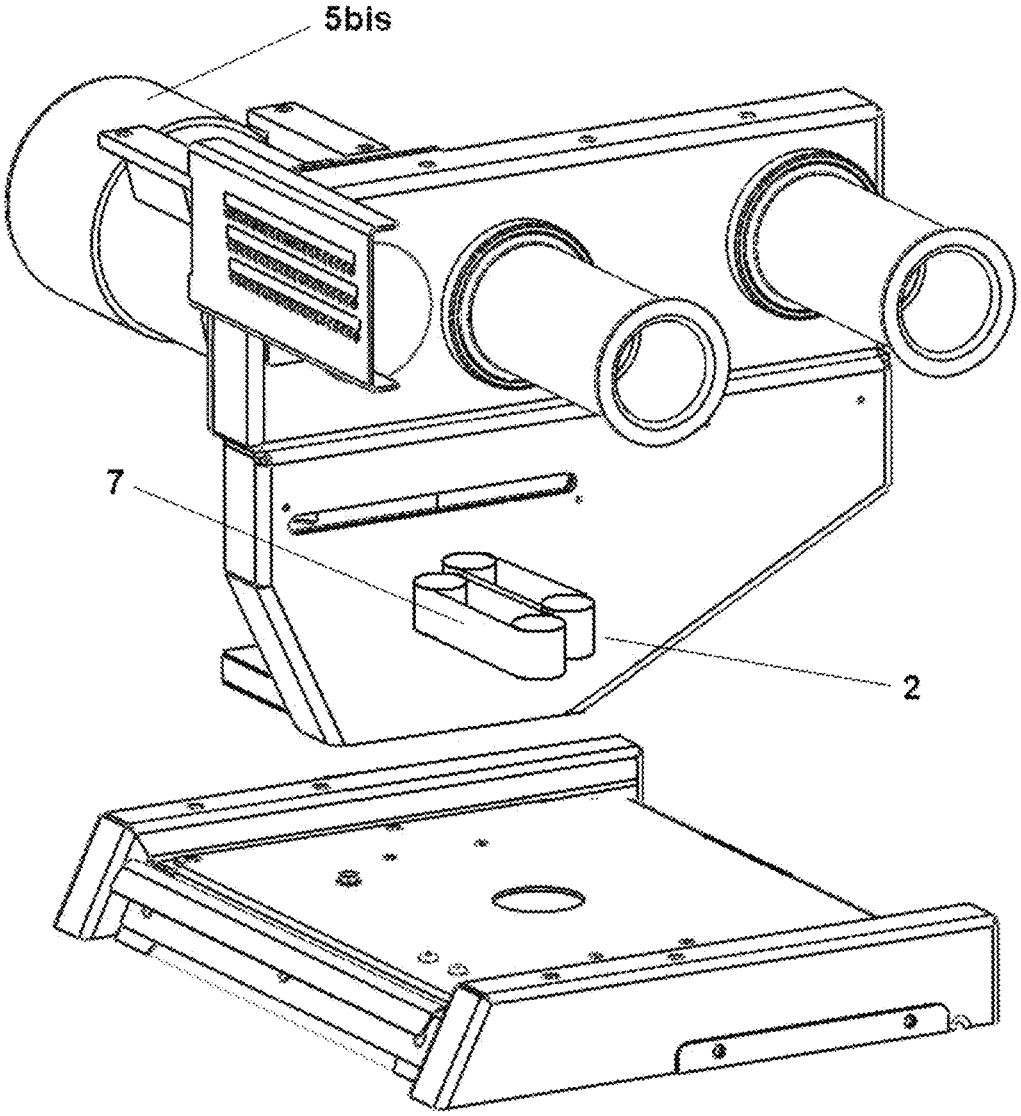
FIG. 3 is a diagrammatic representation of a second embodiment of a device according to the invention.

The present invention relates to a device for guiding a strand 1 of at least two threads on a transporter structure, characterized in that the device employs a mechanism 2 for generating false twists between the at least two threads of the strand 1. Generating false twists between the threads of the strand 1 enables modification along the strand 1 of the position of these threads within a section of the strand 1. This change of position of the threads thanks to these successive false twists makes it possible to obtain a homogeneous distribution of each of the threads within the strand 1. Accordingly, the same thread will be positioned successively and cyclically at different positions in the strand 1 during the formation of this strand 1 of threads from a feed mechanism including a plurality of spools of thread.

Thanks to this respective homogenized distribution of each of the threads along the strand 1, the variations in the length of each of the threads because of their respective positions in the strand 1 when this strand 1 is deposited in loops onto a moving structure such as a conveyor belt are reduced or even eliminated. In fact, during the formation of the strand 1 by grouping a plurality of threads coming from a feed mechanism with a plurality of spools, each of the threads is fed and guided, thanks to a plurality of false twists, so as to be positioned successively and alternately at different positions within or at the periphery of the strand 1.

This homogeneous distribution of the structure of each of the threads within a strand 1 during the formation of the latter makes it possible to homogenize the rate of deposition of these threads within the strand 1 on the moving structure and therefore the feeding and the taking up of each of these threads, respectively on the upstream side and on the downstream side of a treatment system.

In accordance with a preferred mode of construction that is not limiting on the invention, the mechanism 2 for generating false twists is positioned at the level of a portion of the threads of the strand 1 that has an axial tension sufficiently low for a twist to be applicable to its structure.

In fact, in the event of too high an axial tension, twisting of the strand 1 could lead to a risk of one or more threads of the strand 1 breaking In accordance with one non-limiting implementation feature of the invention, the mechanism 2 for generating false twists is positioned on the downstream side of a mechanism for regulating the tension in the threads feeding the strand 1. Because of this, the tension of the threads is situated on the upstream side of the tension regulating mechanism, between the feed spools and this regulating mechanism which pulls the threads from their spools on the upstream side to feed the formation of the strand 1 on the downstream side.

In accordance with one constructional feature, this tension regulating mechanism is formed by one or more rollers mounted to rotate about their respective axes. The threads that feed the strand 1 are then disposed on all or part of the periphery of these rollers to be driven in movement by these rollers. The axis of these rollers is therefore positioned substantially perpendicularly to the axis of movement of the different threads feeding the strand 1. The rollers of the tension regulating mechanism also participate in driving the threads intended to form the strand 1, and tension is then exerted on these threads only on the upstream side of this mechanism during emptying of the feed spools; this tension being released on the downstream side of these rollers at the level of the mechanism 2 for generating false twists.

In accordance with a first embodiment the mechanism 2 for generating false twists includes:

- a disk 3 with perforations 3*a* through it, such that different threads of the strand 1 are able to pass through the disk 3 via respective perforations, the disk 3 being adapted to effect a rotary pendulum movement about an axis perpendicular to the plane of the disk 3.

In accordance with this first embodiment, the number of perforations in the disk 3 is of the same order of magnitude as the number of threads that constitute the strand 1. A thread or a group of threads is then disposed so as to pass through a respective perforation that will guide this thread or this group of threads to position it within the strand 1 being formed. The pendulum rotation of the disk 3 therefore enables the regular generation of false twists along the strand 1.

In accordance with one implementation feature of this first embodiment, the mechanism 2 for generating false twists also includes:

- a structure 4 supporting the disk 3 associated with a frame and adapted to support the disk 3 at the level of at least a portion of its periphery, the disk 3 being mounted so that it can rotate relative to the support structure 4 about an axis perpendicular to the plane of the disk 3,
- a motor 5 for actuating the pendulum rotation of the disk 3.

The support structure 4 of the disk 3 can therefore be formed by an annular structure that surrounds the whole of the disk 3.

In accordance with one implementation feature of this mode of construction, the disk 3 is rotatably mounted on the support structure 4 by way of a ball bearing 6. This bearing 6 therefore has the advantage of optimizing the reduction of friction between the disk 3 and the annular structure 4 that supports the disk 3.

Alternatively, the structure 4 that supports the disk 3 merely includes a circular arc portion intended to interact with the peripheral edge of the disk 3. In this alternative embodiment, the peripheral edge of the disk 3 is then slidably mounted at the level of this circular arc portion whilst enabling positioning of the disk 3 in a plane substantially perpendicular to the axis of movement of the strand 2.

In accordance with one feature of the actuation of the pendulum rotation of the disk 3, the transmission of the pendulum rotation movement between the actuator motor 5 and the rotary disk 3 employs at least one drive belt, which may be notched. At least a portion of this drive belt is therefore positioned over at least a portion of the periphery of the disk 3; another portion of this belt being driven by an element actuated by the actuator motor 5.

In accordance with an alternative way of actuating the pendulum rotation of the disk 3, the transmission of the pendulum rotation movement between the actuator motor 5 and the rotary disk 3 employs at least one pinion-type gear cooperating with a toothed structure disposed on the periphery of the rotary disk 3.

In accordance with one particular mode of construction, the actuator motor 5 is associated with control means enabling management of the amplitude and/or the speed of the pendulum rotation of the rotary disk 3.

In accordance with a first embodiment of the motor 5 for actuating the rotation of the disk 3, the motor generates pendulum rotations of at least one quarter-turn of the disk 3 in opposite directions.

In accordance with a second embodiment of the motor 5 for actuating the rotation of the disk 3, the motor generates pendulum rotations of at least one half-turn of the disk 3 in opposite directions.

In accordance with a third embodiment of the motor 5 for actuating the rotation of the disk 3, the motor generates pendulum rotations of at least one complete turn of the disk 3 in opposite directions.

In accordance with an alternative second embodiment of the mechanism 2 for generating false twists, the latter includes:

- a pair of belts 7 rubbing against each other and between which the strand 1 of threads is moved, the belts being driven in a pendulum movement in opposite directions,
- at least one motor 5*b* is for pendulum actuation of at least one of the belts.

In accordance with this alternative embodiment of the mechanism for generating false twists, the twists applied to the strand 1 of threads are the result of friction and of deformation of the whole of the strand 1 already formed rather than of modification of the distribution of the threads during the step of deforming the strand 1.

In accordance with an alternative third embodiment of the mechanism for generating false twists, the latter includes:

- an axial structure adapted for axial pendulum rotation positioned perpendicularly to the axis of movement of the strand 1 and around which the moving strand 1 effects at least one twist.

In accordance with this alternative embodiment of the mechanism for generating false twists, the twists applied to the strand 1 of threads are also, as in the alternative second embodiment, the result of friction and of a deformation of the whole of the strand 1 already formed.

The invention also relates to a system for treating threads for carpets, characterized in that the system includes a device according to the invention for guiding a strand 1 of at least one thread on a transporter structure, this device for guiding a strand 1 being positioned between a mechanism for feeding the strand 1 with threads and a mechanism for depositing the strand 1 on a transporter structure.

The invention further relates to a method of guiding a strand 1 of at least two threads on a transporter structure, characterized in that it includes at least one step of generating at least one false twist of the strand 1 before the step of placing the strand 1 on the transporter structure.

Of course, the invention is not limited to the embodiment described and represented in the appended drawings. Modifications remain possible, notably from the point of view of the constitution of the various elements or substitution of technical equivalents, without this departing from the scope of protection of the invention.

What is claimed:

1. A system for treating threads for carpets comprising:

a guiding device configured to guide at least two threads of a strand onto a transporter structure, wherein the guiding device comprises a false twisting device configured to generate false twists between the at least two threads of the strand, and wherein the guiding device is positioned upstream of a mechanism for depositing the strand in loops on the transporter structure, wherein the transporter structure is configured to move the loops in a longitudinal direction, and wherein on the guiding device, a tension of the at least two threads of the strand at the false twisting device is lower than the tension of the at least two threads of the strand upstream of the false twisting device.

2. The system for treating threads for carpets as claimed in claim 1, wherein the false twisting device comprises:

a disk having perforations through it so that different threads of the strand are able to pass through the disk at a level of respective perforations, the disk being adapted to perform a rotary pendulum movement about an axis perpendicular to a plane of the disk.

3. The system for treating threads for carpets as claimed in claim 2, wherein the false twisting device further comprises:

a support structure supporting the disk, wherein the support structure is associated with a frame and adapted to support the disk at a level of at least a portion of its periphery, the disk being rotatable relative to the support structure about an axis perpendicular to the plane of the disk, and a motor for actuating the rotary pendulum movement of the disk.

4. The system for treating threads for carpets as claimed in claim 3, wherein the support structure surrounds the disk over an entirety of its periphery and the disk is rotatably mounted on the support structure by way of a ball bearing.

5. The system for treating threads for carpets as claimed in claim 3, wherein at least one drive belt drives transmission of the rotary pendulum movement between the motor and the disk.

6. The system for treating threads for carpets as claimed in claim 3, wherein the motor for actuating the rotary pendulum movement of the disk generates pendulum rotations of at least one quarter-turn of the disk in opposite directions.

7. The system for treating threads for carpets as claimed in claim 3, wherein the motor for actuating the rotary pendulum movement of the disk generates pendulum rotations of at least one half-turn of the disk in opposite directions.

8. The system for treating threads for carpets as claimed in claim 3, wherein the motor for actuating the rotary pendulum movement of the disk generates pendulum rotations of at least one complete turn of the disk in opposite directions.

9. The system for treating threads for carpets claimed in claim 1, wherein the false twisting device comprises:

a pair of belts rubbing against each other and between which the threads of the strand are moved, the pair of belts being driven with a pendulum movement in opposite directions, and at least one motor for pendulum actuation of at least one of the pair of belts.

10. The system for treating threads for carpets as claimed in claim 1, wherein the false twisting device comprises:

an axial structure adapted for axial pendulum rotation positioned perpendicularly to an axis of movement of the strand and around which the strand effects at least one twist as the strand is moved by the false twisting device.

11. The system for treating threads for carpets as claimed in claim 1, wherein the guiding device is positioned between a mechanism for feeding the strand with at least two threads and the mechanism for depositing the strand on the transporter structure.

12. A method of guiding at least two threads of a strand onto a transporter structure, the method comprising:

generating at least one false twist of the strand between at least two threads of the strand, wherein a tension of the strand when the at least one false twist is generated is lower than the tension of the strand before the false twist is generated;

depositing the strand in loops on the transporter structure; and moving the loops in a longitudinal direction via the transporter structure.

13. The system for treating threads for carpets as claimed in claim 5, wherein the at least one drive belt is notched.

* * * * *